US009255375B2

(12) United States Patent
Yingling et al.

(10) Patent No.: US 9,255,375 B2
(45) Date of Patent: Feb. 9, 2016

(54) HELMET ADAPTER FOR PILE DRIVERS

(71) Applicant: American Piledriving Equipment, Inc., Kent, WA (US)

(72) Inventors: David A. Yingling, Covington, WA (US); Joseph G. Wright, Magnolia, TX (US); Steven N. Cress, Antioch, CA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 14/482,827

(22) Filed: Sep. 10, 2014

(65) Prior Publication Data

US 2014/0377011 A1 Dec. 25, 2014

Related U.S. Application Data

(63) Continuation of application No. 12/789,221, filed on May 27, 2010, now abandoned.

(60) Provisional application No. 61/181,639, filed on May 27, 2009.

(51) Int. Cl.

| | |
|---|---|
| ***E02D 7/00*** | (2006.01) |
| ***E02D 7/02*** | (2006.01) |
| ***E02D 7/06*** | (2006.01) |

(52) U.S. Cl.

CPC ... *E02D 7/02* (2013.01); *E02D 7/06* (2013.01)

(58) Field of Classification Search

CPC ..... E02D 13/10; E02D 13/04
USPC ..... 405/232, 228, 256, 253; 173/210, 90, 173/128, 133
See application file for complete search history.

(56) References Cited

U.S. PATENT DOCUMENTS

| | | | |
|---|---|---|---|
| 1,348,994 | A | 8/1920 | Heckle |
| 1,769,169 | A | 7/1930 | Thornley |

(Continued)

FOREIGN PATENT DOCUMENTS

| | | | |
|---|---|---|---|
| JP | 9328983 | A | 12/1997 |
| KR | 1020010044658 | A | 5/2001 |
| KR | 1020030017742 | A | 4/2003 |

OTHER PUBLICATIONS

American Piledriving Equipment, Inc., "Model 8 Hydraulic Impact Hammer," 1 page.

(Continued)

*Primary Examiner* — Doug Hutton, Jr.
*Assistant Examiner* — Patrick Lambe
(74) *Attorney, Agent, or Firm* — Schacht Law Office, Inc.; Michael R. Schacht

(57) ABSTRACT

An adapter assembly for transmitting a drive force from a pile driving system defining a drive axis to a pile defining a pile axis comprising a base assembly and an adapter assembly. The base assembly is operatively supported such that the drive force is transmitted to the base assembly. The adapter assembly comprises a plate member, a skirt member defining a skirt chamber, and an adapter connector configured to support the skirt member relative to the base assembly, the plate member, and the pile member. The adapter assembly substantially aligns the drive axis with the pile axis. The drive force is transmitted from the base assembly to the plate member. The pile is received within the skirt chamber such that the drive force is transmitted from the plate member to the pile. The skirt member is substantially isolated from the drive force.

17 Claims, 8 Drawing Sheets

(56) References Cited

U.S. PATENT DOCUMENTS

| | | | | | |
|---|---|---|---|---|---|
| 2,723,532 | A | * | 11/1955 | Smith | 173/131 |
| 2,755,783 | A | | 7/1956 | Kupka | |
| 2,904,964 | A | | 9/1959 | Kupka | |
| 3,001,515 | A | | 9/1961 | Haage | |
| 3,034,304 | A | | 5/1962 | Upson | |
| 3,193,026 | A | | 7/1965 | Kupka | |
| 3,267,677 | A | | 8/1966 | Bollar | |
| 3,616,453 | A | | 10/1971 | Philpot | |
| 3,638,738 | A | | 2/1972 | Varnell | |
| 3,789,930 | A | | 2/1974 | Nishimura et al. | |
| 3,797,585 | A | | 3/1974 | Ludvigson | |
| 3,822,969 | A | | 7/1974 | Kummel | |
| 3,967,688 | A | | 7/1976 | Inenaga et al. | |
| 3,975,918 | A | | 8/1976 | Jansz | |
| 3,991,833 | A | | 11/1976 | Ruppert | |
| 4,029,158 | A | | 6/1977 | Gerrish | |
| 4,076,081 | A | | 2/1978 | Schnell | |
| 4,102,408 | A | | 7/1978 | Ludvigson | |
| 4,109,475 | A | | 8/1978 | Schnell | |
| 4,154,307 | A | | 5/1979 | Gendron et al. | |
| 4,187,917 | A | | 2/1980 | Bouyoucos | |
| 4,262,755 | A | | 4/1981 | Kuhn | |
| 4,362,216 | A | | 12/1982 | Jansz | |
| 4,366,870 | A | | 1/1983 | Frederick | |
| 4,367,800 | A | * | 1/1983 | Arentsen | 173/127 |
| 4,382,475 | A | | 5/1983 | Suzuki | |
| 4,421,180 | A | | 12/1983 | Fleishman et al. | |
| 4,430,024 | A | | 2/1984 | Guild et al. | |
| 4,465,145 | A | | 8/1984 | Kuhn | |
| 4,497,376 | A | | 2/1985 | Kurylko | |
| 4,624,325 | A | | 11/1986 | Steiner | |
| 4,626,138 | A | | 12/1986 | Boyes | |
| 4,725,167 | A | | 2/1988 | Merjan | |
| 4,799,557 | A | | 1/1989 | Jacquemet | |
| 4,844,661 | A | | 7/1989 | Martin et al. | |
| 4,915,180 | A | | 4/1990 | Schisler | |
| 4,974,997 | A | | 12/1990 | Sero et al. | |
| 4,989,677 | A | | 2/1991 | Lam | |
| 4,993,500 | A | | 2/1991 | Greene et al. | |
| 5,088,565 | A | | 2/1992 | Evarts | |
| 5,107,934 | A | | 4/1992 | Atchison | |
| 5,117,925 | A | | 6/1992 | White | |
| 5,154,667 | A | | 10/1992 | Mauch et al. | |
| 5,161,625 | A | | 11/1992 | Seng | |
| 5,263,544 | A | | 11/1993 | White | |
| 5,355,964 | A | | 10/1994 | White | |
| 5,526,885 | A | | 6/1996 | Kuvshinov et al. | |
| 5,529,132 | A | | 6/1996 | Evarts | |
| 5,544,979 | A | | 8/1996 | White | |
| 5,549,168 | A | | 8/1996 | Sadler et al. | |
| 5,551,804 | A | | 9/1996 | Breaux et al. | |
| 5,609,380 | A | | 3/1997 | White | |
| 5,653,556 | A | | 8/1997 | White | |
| 5,727,639 | A | | 3/1998 | Jeter | |
| 5,788,419 | A | | 8/1998 | Whitty, Jr. et al. | |
| 5,794,716 | A | | 8/1998 | White | |
| 5,806,610 | A | | 9/1998 | Sapozhnikov | |
| 5,924,498 | A | | 7/1999 | Nilsen | |
| 5,934,835 | A | | 8/1999 | Whitty, Jr. et al. | |
| 6,003,619 | A | | 12/1999 | Lange | |
| 6,039,508 | A | | 3/2000 | White | |
| 6,056,070 | A | | 5/2000 | Shinohara et al. | |
| 6,102,133 | A | | 8/2000 | Scheid et al. | |
| 6,129,487 | A | | 10/2000 | Bermingham et al. | |
| 6,155,353 | A | | 12/2000 | Ottestad | |
| 6,186,043 | B1 | | 2/2001 | Callies | |
| 6,224,294 | B1 | | 5/2001 | Mansfield | |
| 6,227,767 | B1 | | 5/2001 | Mosing et al. | |
| 6,364,577 | B1 | | 4/2002 | Haney | |
| 6,378,951 | B1 | | 4/2002 | Bouyoucos et al. | |
| 6,427,402 | B1 | | 8/2002 | White | |
| 6,431,795 | B2 | | 8/2002 | White | |
| 6,447,036 | B1 | | 9/2002 | White | |
| 6,543,966 | B2 | | 4/2003 | White | |
| 6,557,647 | B2 | | 5/2003 | White | |
| 6,648,556 | B1 | | 11/2003 | White | |
| 6,672,805 | B1 | | 1/2004 | White | |
| 6,691,797 | B1 | | 2/2004 | Hart | |
| 6,732,483 | B1 | | 5/2004 | White | |
| 6,736,218 | B1 | | 5/2004 | White | |
| 6,896,448 | B1 | | 5/2005 | White | |
| 6,908,262 | B1 | | 6/2005 | White | |
| 6,942,430 | B1 | | 9/2005 | Suver | |
| 6,988,564 | B2 | | 1/2006 | White | |
| 7,168,890 | B1 | | 1/2007 | Evarts | |
| 7,392,855 | B1 | | 7/2008 | White | |
| 7,404,449 | B2 | | 7/2008 | Bermingham et al. | |
| 7,591,612 | B2 | | 9/2009 | Wong | |
| 7,972,083 | B2 | | 7/2011 | Jones | |
| 2003/0143036 | A1 | | 7/2003 | Larsen, Jr. | |
| 2006/0216118 | A1 | | 9/2006 | Wong | |
| 2010/0303552 | A1 | | 12/2010 | Yingling et al. | |

OTHER PUBLICATIONS

MKT Corporation, "Operating, Maintenance and Parts Manual for MS350 and MS500 Single-Acting Pile Hammers," 12 pages.
ISA, ISR, PCTUS2010036457, Jan. 28, 2011, 11 pages.

* cited by examiner

HELMET ADAPTER FOR PILE DRIVERS

RELATED APPLICATIONS

This application, U.S. patent application Ser. No. 14/482,827 is a continuation of U.S. patent application Ser. No. 12/789,221 filed May 27, 2010, now abandoned.

U.S. patent application Ser. No. 12/789,221 claims the benefit of U.S. Provisional Patent Application Ser. No. 61/181,639 filed May 27, 2009, now expired.

The contents of all related applications listed above are incorporated herein by reference.

TECHNICAL FIELD

The present invention relates to adapters for pile drivers and, more specifically, to helmet adapters used to align pile drivers with the pile being driven.

BACKGROUND

Many construction projects are engineered to employ elongate members, referred to as piles, which are inserted into the earth. Piles are engineered in many different physical configurations depending upon the location and use of the pile. Typically, pile driving systems and methods are used to facilitate the insertion of a pile into the earth. The physical characteristics of the pile to be driven into the earth and the nature of the earth where the pile is to be driven typically determine the nature of the pile driving system.

Pile driving systems can be categorized as hammer systems, vibratory systems, crowding systems, and certain combinations of these systems. The present invention is of particular significance in the context of a hammer pile driving system and will be described herein in that context. A hammer pile driving system can take many forms, but each of these forms results in a weighted member generating a series of impact forces substantially along the longitudinal axis of the pile in the direction of the earth.

One purpose of the present invention is to provide improved hammer drive systems and methods of the present invention.

SUMMARY

The present invention may be embodied as an adapter assembly for transmitting a drive force from a pile driving system defining a drive axis to a pile defining a pile axis comprising a base assembly and an adapter assembly. The base assembly is operatively supported such that the drive force is transmitted to the base assembly. The adapter assembly comprises a plate member, a skirt member defining a skirt chamber, and an adapter connector configured to support the skirt member relative to the base assembly, the plate member, and the pile member. The adapter assembly substantially aligns the drive axis with the pile axis. The drive force is transmitted from the base assembly to the plate member. The pile is received within the skirt chamber such that the drive force is transmitted from the plate member to the pile. The skirt member is substantially isolated from the drive force.

The present invention may also be embodied as a pile driving system for driving a pile defining a pile axis. Such a pile driving system comprises a hammer, a base assembly, and an adapter assembly. The hammer applies a drive force to a drive member along a drive axis. The base assembly is operatively supported relative to the drive member such that the drive force is transmitted to the base assembly. The adapter assembly comprises a plate member, a skirt member defining a skirt chamber, and an adapter connector configured to support the skirt member relative to the base assembly, the plate member, and the pile member. The adapter assembly substantially aligns the drive axis with the pile axis. The drive force is transmitted from the base assembly to the plate member. The pile is received within the skirt chamber such that the drive force is transmitted from the plate member to the pile. The skirt member is substantially isolated from the drive force.

The present invention may also be embodied as a method of driving a pile defining a pile axis comprising the following steps. A base assembly is operatively supported relative to a drive member. A skirt member defining a skirt chamber is operatively supported relative to a plate member. The pile is arranged within the skirt chamber such that a drive axis is substantially aligned with the pile axis. A drive force is applied to the drive member along the drive axis such that the drive force is transmitted from the drive member to the pile through the base assembly and the plate member. The skirt member is substantially isolated from the plate member as the drive force is transmitted to the pile.

DETAILED DESCRIPTION

The present invention may be embodied in many different forms depending upon the type of hammer system used and type of pile being driven. Several different example drive systems constructed in accordance with, and embodying, the principles of the present invention will be described below.

A. First Example Drive System

Figure 1:
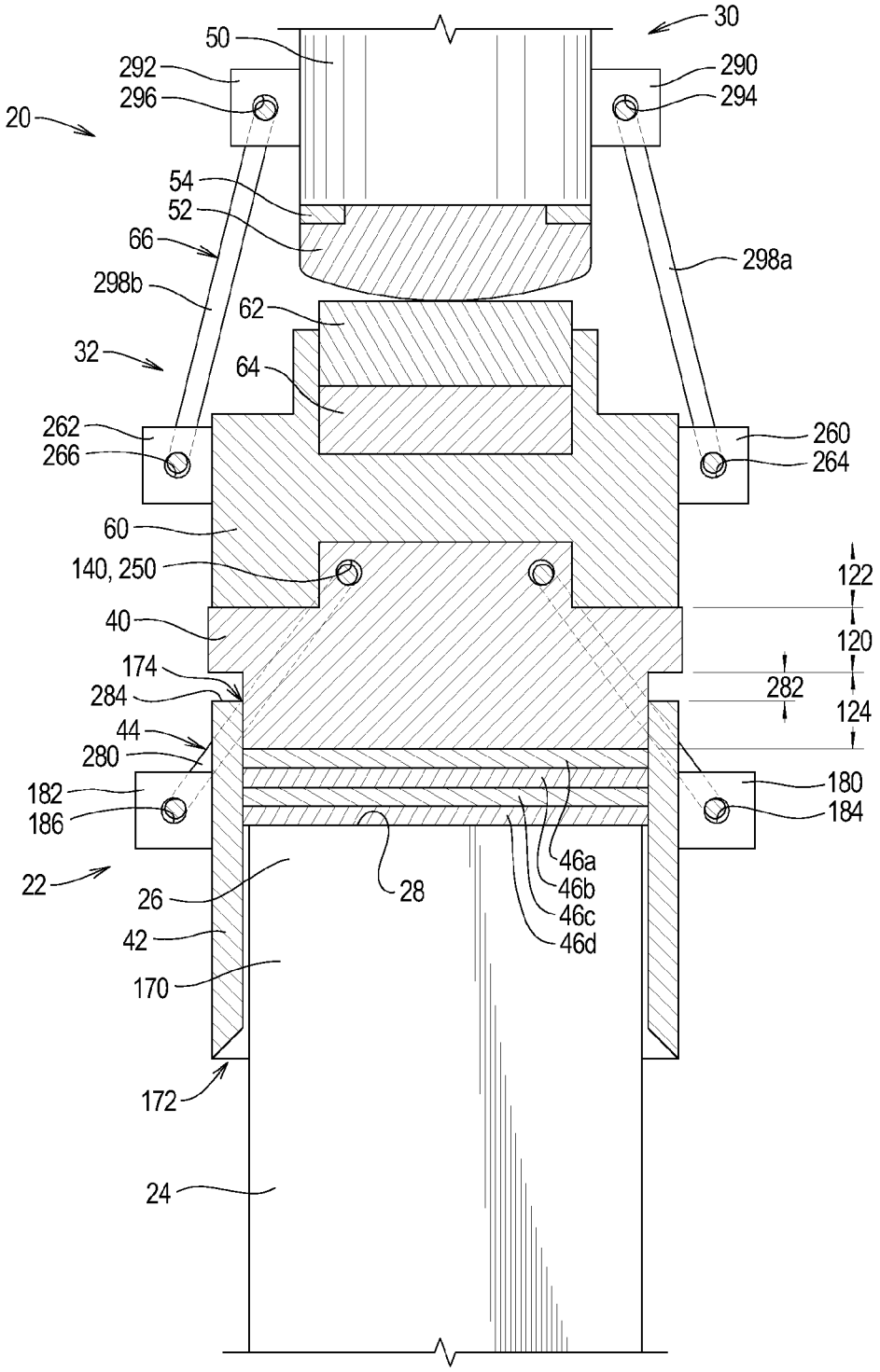
FIG. 1 is an elevation, sectional view of a first example drive system for concrete piles employing a first example adapter assembly of the present invention.
Figure 2:
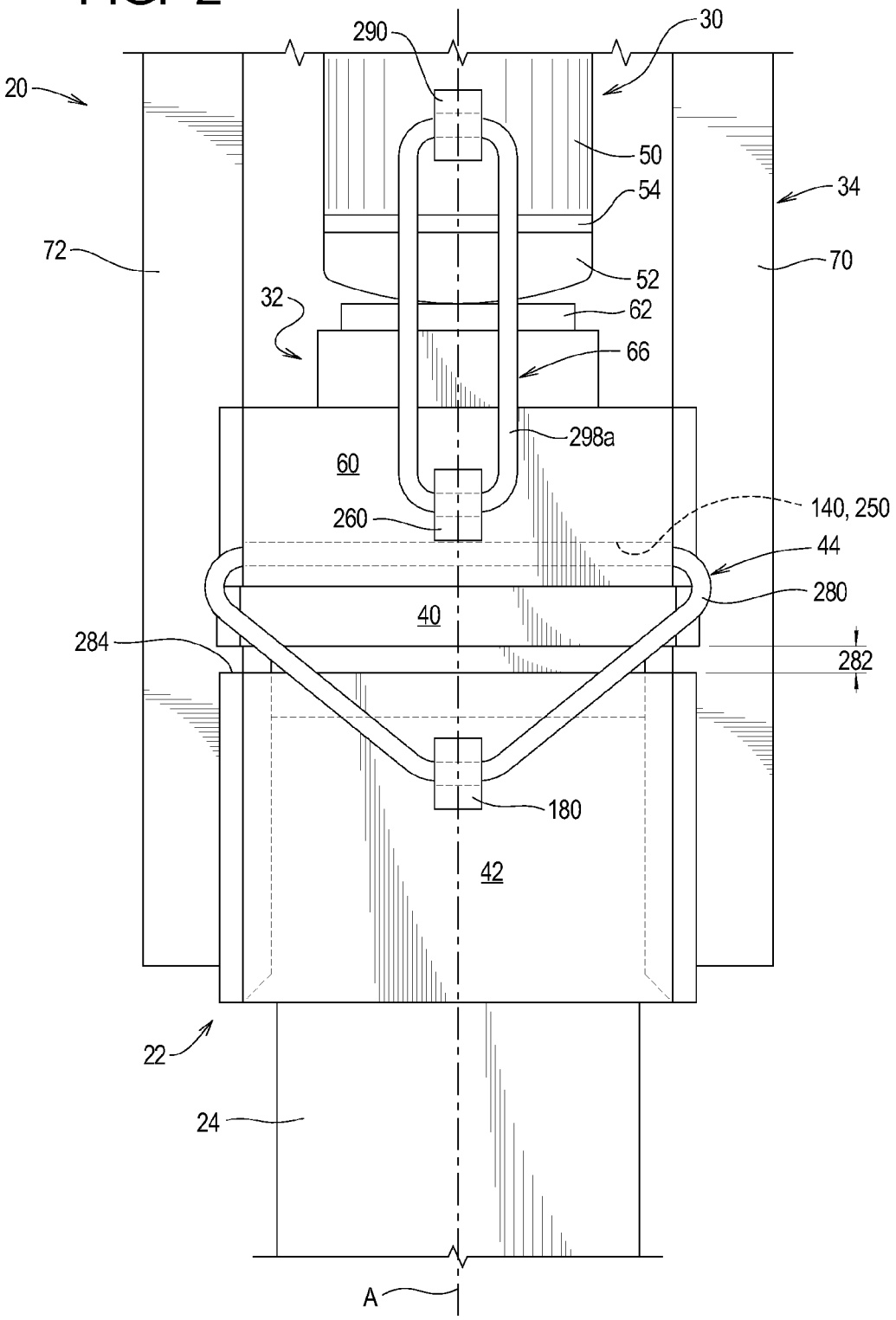
FIG. 2 is an elevation view of the first example drive system for concrete piles depicted in FIG. 1.

Referring initially to FIGS. 1 and 2 of the drawing, depicted therein is a first example drive system 20 comprising a first example adapter assembly 22 embodying, and constructed in accordance with, the principles of the present invention. The example first drive system 20 is configured to drive a pile 24 defining a pile upper end 26 and a pile upper surface 28. The example pile 24 is a concrete pile having a generally rectangular cross-section, but, as will be described in further detail below, the principles of the present invention may be applied to piles of other materials such as steel or wood and having other cross-sections such as circular.

In addition to the adapter assembly 22, the first example drive system 20 comprises a hammer system 30, a base assembly 32, and a guide system 34 (FIG. 2). The example adapter assembly 22 comprises a plate member 40, a skirt member 42, an adapter connector system 44, and one or more cushion members 46. The adapter assembly 22 comprises four cushion members 46*a-d* in the form of rectangular pieces of plywood. The adapter connector system 44 is adapted to support the skirt member 42 relative to the plate member 40.

With the drive system 20 in a driving configuration, the guide system 34 aligns the base assembly 32 below the hammer system 30, the plate member 40 below the base assembly 32, and the skirt member 42 below the plate member 40 such that the skirt member 42 extends around at least the upper end 26 of the pile 24. The skirt member 42 further supports the cushion members 46*a-d* between the plate member 40 and the upper end 26 of the pile 24. The skirt member 42 is thus configured to align the pile 24 in a predetermined orientation with the plate member 40 and to maintain the at least one cushion member 46 between the plate member 40 and the pile 24.

When the drive system 20 is in the driving configuration, operation of the hammer system 30 applies a driving force on the base assembly 32. The base assembly 32 transmits at least a portion of the driving force to the plate member 40, and at least a portion of the driving force applied to the plate member 40 is in turn applied to the pile 24 through the cushion members 46*a-d*. Operation of the hammer system 30 thus applies a driving force to the pile 24.

The use of an adapter connector system 44 to support a skirt member 42 from a plate member 40 allows the driving force to be transmitted to the pile 24 without significant driving forces being applied to the skirt member 42. The skirt member 42 still effectively functions to align the plate member 40 with the pile 24 and to hold the cushion members 46*a-d* in position between the plate member 40 and the pile 24.

Given the foregoing general understanding of the construction and operation the first example drive system 20 of the present invention, the details of the construction and operation of the drive system 20 will now be described with reference to FIGS. 1-5.

The example hammer system 30 comprises a drive housing 50, a drive or anvil member 52, and an anvil cushion 54. When the hammer system 30 is operated, the drive member 52 is displaced downwardly in FIGS. 1 and 2 relative to the drive housing 50. The construction and operation of hammer systems such as the example hammer system 30 is well-known in the art and will not be described herein beyond that extent necessary for a complete understanding of the present invention.

The example hammer system 30 is a diesel hammer. Examples of diesel hammers that may be used as the hammer system 30 are described, for example, in U.S. Pat. Nos. 6,736,218 and 6,988,564, and the contents of the '218 and '564 patents are incorporated herein by reference. Alternatively, the hammer system 30 may take other forms such as a drop hammer or a hydraulic hammer. The hammer system 30 may thus also take the form of the hammer disclosed in U.S. Pat. No. 6,557,647, and the contents of the '647 patent are also incorporated herein by reference.

The example base assembly 32 comprises a base member 60, a strike plate 62, and a hammer cushion 64. The construction and operation of base assemblies such as the example base assembly 32 is well-known in the art and will not be described herein beyond that extent necessary for a complete understanding of the present invention.

The example base assembly 32 is adapted to transfer forces generated by the hammer system 30 to the adapter assembly 22. In particular, a base connecting system 66 suspends the base member 60 from the drive housing 50, and the base member 60 supports the strike plate 62 above the hammer cushion 64 and below the drive member 52. Accordingly, when the drive member 52 is displaced relative to the drive housing 50, the drive member 52 engages the strike plate 62 to apply a drive force to the strike plate 62. The drive force applied to the strike plate 62 is in turn transferred through the drive cushion 64 to the base member 60. The first example drive base assembly 32 is thus configured to transfer forces from the drive member 52 of the example hammer system 30 to the adapter assembly 22.

As shown in FIG. 2, the guide system 34 comprises first and second guide rails 70 and 72 (FIG. 2). The guide rails 70 and 72 are held in a parallel relationship to define a drive axis A. The guide rails 70 and 72 engage the hammer system 30, base assembly 32, and adapter assembly 22 such that the drive forces transmitted from the hammer system 30 to the pile 24 as described above are substantially directed along the drive axis A. The adapter assembly 22 is further configured such that the pile 24 is supported such that a longitudinal axis of the pile is also substantially aligned with the drive axis A. The drive forces generated by the drive system 20 are thus transmitted to the pile 24 substantially along the drive axis A. The drive axis A is typically substantially vertical or canted at a desired angle with respect to vertical and directed at a desired location in the earth. The guide system 34 may take the form of a lead assembly supported by a spotter or crane. The construction and operation of guide systems 34 such as the example guide system 34 is well-known in the art and will not be described herein beyond that extent necessary for a complete understanding of the present invention.

The details of construction and assembly of the example adapter assembly 22 relative to the example base assembly 32 will now be described in further detail with respect to FIGS. 3-5.

Figure 4A:
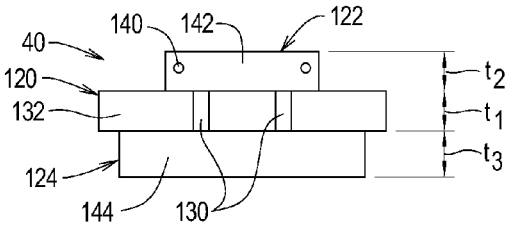
FIG. 4A is an elevation view of an example plate member of the first example adapter assembly of FIG. 1.
Figure 4B:
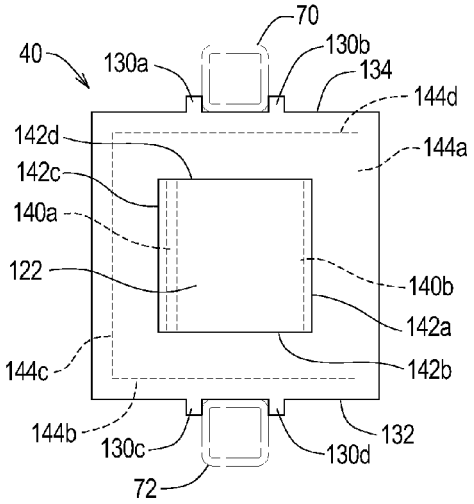
FIG. 4B is a top plan view of the example plate member depicted in FIG. 4A.

As shown in FIGS. 4A and 4B, the plate member 40 is a solid member comprising a center portion 120, an adapter base portion 122, and a skirt adapter portion 124. The example center portion 120, adapter base portion 122, and skirt adapter portion 124 are rectangular solids, with a cross-sectional area of the center portion 120 being larger than cross-sectional areas of the adapter base portion 122 and the skirt adapter portion 124. Thicknesses t1, t2, and t3 of the portions 120, 122, and 124 are defined by the environment in which the drive system 20 is to be used and the details of the base assembly 32 and the skirt member 42.

A plurality of rail guides 130 extend from opposing edge portions 132 and 134 of the plate center portion 120. The example plate member 40 comprises four rail guides 130*a-d* spaced from each other to engage the rails 70 and 72 of the guide system 34 as shown in FIG. 4B. The opposing edge portions 132 and 134 are also spaced from each other a distance defined by the spacing between the rails 70 and 72.

At least one plate connector bore 140 is formed in the adapter base portion 122; the example plate member 40 comprises first and second plate bores 140*a* and 140*b*. The adapter base portion 122 further defines at least one first alignment surface 142, and the skirt adapter portion 124 defines at least one second alignment surface 144. As shown in FIG. 4B, the example adapter base portion 122 comprises four first alignment surfaces 142*a-d*, and the example skirt adapter portion 124 defines four second alignment surfaces 144*a-d*. As will be described in further detail below, configuration of the alignment surface(s) 142 is defined by the base member 60 and the configuration of the alignment surface(s) 144 is defined by the skirt member 42.

Figure 3A:
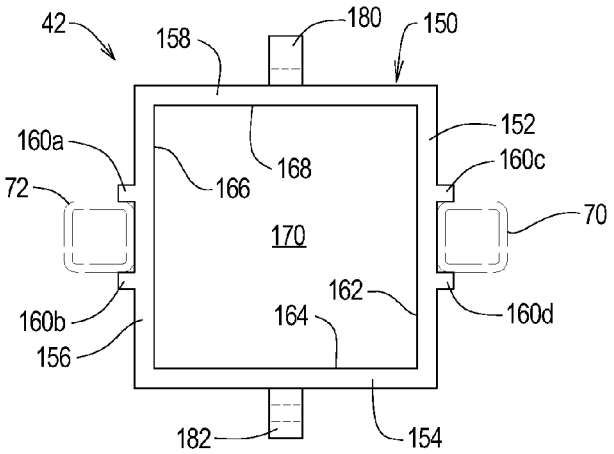
FIG. 3A is a top plan view of an example skirt member of the first example adapter assembly of FIG. 1.
Figure 3B:
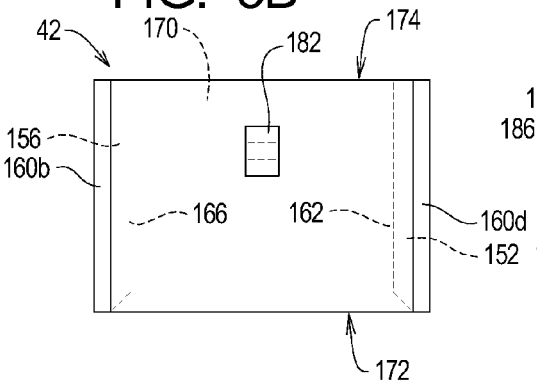
FIG. 3B is a first elevation view of the example skirt member depicted in FIG. 3A.
Figure 3C:
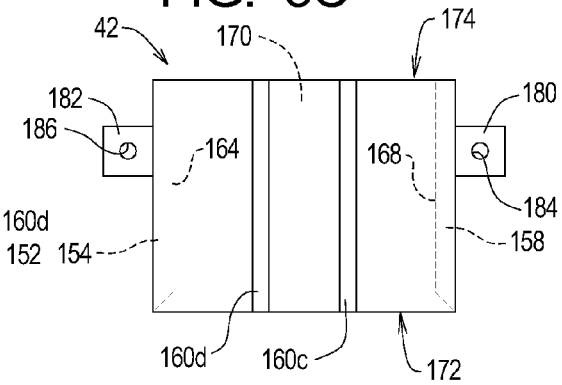
FIG. 3C is a second elevation view of the example skirt member depicted in FIG. 3A.

As shown in FIGS. 3A-3C, the skirt member 42 is a solid member comprising a wall 150. The wall 150 comprises four wall portions 152, 154, 156, and 158. A plurality of rail guides 160 extend from opposing wall portions 152 and 156 of the skirt member 42. As shown in FIG. 3A, the example skirt member 42 comprises four rail guides 160*a-d* spaced from each other to engage the rails 70 and 72 of the guide system 34. The opposing wall portions 154 and 158 are also spaced from each other a distance defined by the spacing between the rails 70 and 72. The wall portions 152, 154, 156, and 158 define inner surfaces 162, 164, 166, and 168 respectively.

The skirt member 42 defines a skirt chamber 170, a pile opening 172, and a plate opening 174. The skirt chamber 170 is sized and dimensioned to receive the upper end 26 of the pile 24. In particular, the example pile 24 is a concrete pile having a substantially rectangular cross-section; the skirt chamber 170 thus also defines a rectangular cross-section slightly larger than that of the pile 24. The pile 24 is inserted into the skirt chamber 170 through the pile opening 172 as shown in FIG. 1.

The alignment surfaces 144 described above are sized and dimensioned to be received within the skirt chamber 170 as shown in FIG. 1. In particular, at least a portion of the skirt adapter portion 124 is inserted into the plate opening 174, and the walls 152-158 are in contact with or are closely adjacent to the alignment surfaces 144*a-d* to align the skirt member 42 with the plate member 40.

FIGS. 3A-3C illustrate that first and second skirt connecting flanges 180 and 182 extend from the wall portions 154 and 158. These skirt connecting flanges 180 and 182 define first and second skirt connecting openings 184 and 186, respectively.

Figure 5A:
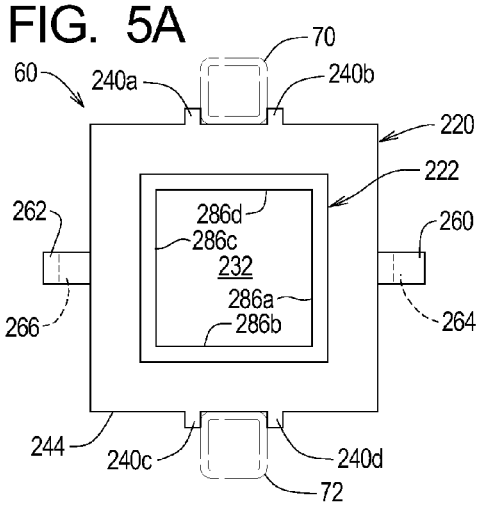
FIG. 5A is top plan view of an example base member of the example drive system of FIGS. 1 and 2.
Figure 5B:
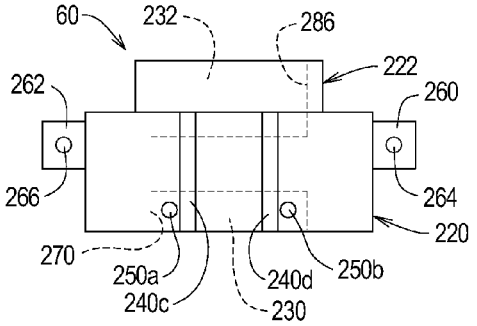
FIG. 5B is an elevation view of the example base member of FIG. 5A.
Figure 5C:
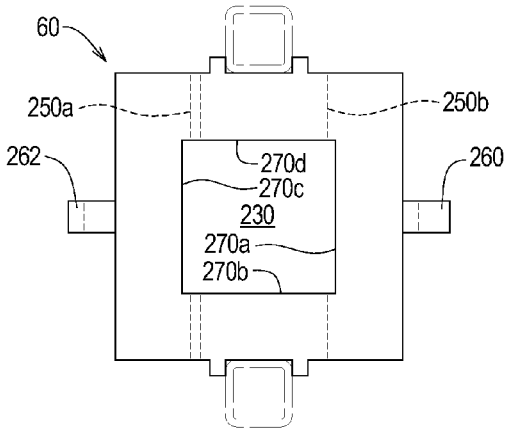
FIG. 5C is a bottom plan view of the example base member of FIG. 5A.

Turning now to FIGS. 5A-C, the example base member 60 will be described in further detail. The example base member 60 is a solid member comprising a main portion 220 and a flange portion 222. An adapter cavity 230 is formed in the main portion 220, while a drive cavity 232 extends through the flange portion 222 and partly into the main portion 220.

A plurality of rail guides 240 extend from opposing surface portions 242 and 244 of the main portion 220. As shown in FIG. 5A, the example base member 60 comprises four rail guides 240*a-d* spaced from each other to engage the rails 70 and 72 of the guide system 34. The opposing surface portions 242 and 244 are also spaced from each other a distance defined by the spacing between the rails 70 and 72.

At least one plate connector bore 250 is formed in the main portion 220; in particular, the example base member 60 comprises first and second base bores 250*a* and 250*b*. First and second drive connecting flanges 260 and 262 extend from the main portion 120. These drive connecting flanges 260 and 262 define first and second drive connecting openings 264 and 266, respectively.

The main portion 220 of the base member 60 defines at least one alignment surface 270 defining the adapter cavity 230. The example main portion 220 defines four alignment surfaces 270*a-d* in a rectangular configuration that is slightly greater in cross-sectional area than the cross-sectional area of the adapter base portion 122 of the plate member 40. The example adapter cavity 230 of the base member 60 is thus sized and dimensioned to receive the adapter portion 122 of the plate member 40. With the adapter portion 122 properly received by the adapter cavity 230, the base bores 250*a* and 250*b* are aligned with the plate bores 140*a* and 140*b* as shown in FIG. 1.

As perhaps best shown in FIGS. 1 and 2, the adapter connector system 44 may be formed by one or more cables 280 inserted through the aligned plate bores 140 and base bores 250 and through the skirt connecting openings 184 and 186 to secure the plate member 40 to the base member 60 and to the skirt member 42. As shown in FIGS. 1 and 2, the cables 280 should have some slack to allow a gap 282 between an upper edge 284 of the skirt member 42 and the main portion 120 of the plate member 40 when the drive system 20 is in use. Other connecting systems may be used to connect the various members 60, 40, and/or 42 together. For example, while a single cable 280 is used to connect the plate member 40 to the base member 60 and to the skirt member 42 in the example drive system 20, a first connector may be used to connect to the plate member 40 to the base member 60 and a second connector may be used to plate member 42 to the skirt member 42.

The flange portion 222 and main portion 220 of the base member 60 further define at least one alignment surface 286 defining the drive cavity 232. In particular, four alignment surfaces 286*a-d* are arranged in a rectangular configuration that is slightly greater in cross-sectional area than the cross-sectional area of the strike plate 62 and the drive cushion 64. The example drive cavity 232 of the base member 60 is thus sized and dimensioned to support the strike plate 62 and drive cushion 64 as shown in FIG. 1 such that displacement of the drive member 52 is transmitted to the base member 60 through the strike plate 62 and the drive cushion 64.

Additionally, FIGS. 1 and 2 illustrate that first and second housing connecting flanges 290 and 292 extend from the drive housing 50. These housing connecting flanges 290 and 292 define first and second housing connecting openings 294 and 296, respectively. The base connector system 66 may be formed by one or more cables 298 inserted through the drive connecting openings 264 and 266 and the housing connecting openings 294 and 296; FIG. 2 illustrates that the example drive system 220 employs first and second cables 298*a* and 298*b*. The cables 298*a* and 298*b* are slightly slack when the drive system 20 is operating to allow movement of the base assembly 60 and adapter assembly 22 relative to the drive housing 50 when the drive member 52 is displaced relative to the drive housing 50.

B. Second Example Drive System

Figure 6:
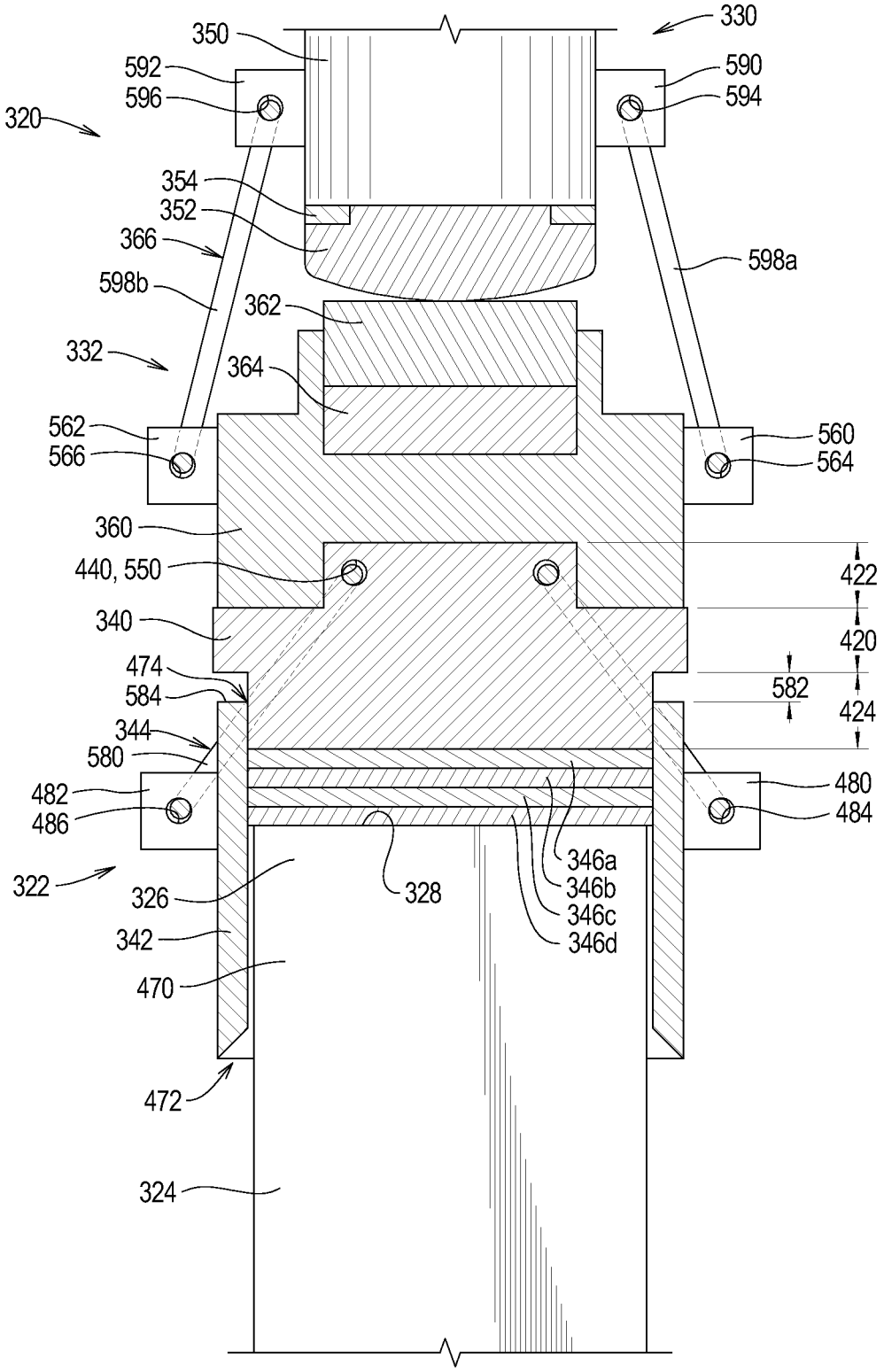
FIG. 6 is an elevation, sectional view of a second example drive system for concrete piles employing a second example adapter assembly of the present invention.

Referring now to FIG. 6 of the drawing, depicted therein is a second example drive system 320 comprising a second example adapter assembly 322 embodying, and constructed in accordance with, the principles of the present invention. The example second drive system 320 is configured to drive a pile 324 defining a pile upper end 326 and a pile upper surface 328. The example pile 324 is a concrete pile having a generally circular cross-section, but, as will be described in further detail below, the principles of the present invention may be applied to piles of other materials such as steel or wood and having other cross-sections such as circular.

In addition to the adapter assembly 322, the first example drive system 320 comprises a hammer system 330, a base assembly 332, and a guide system (not shown). The guide system may be like the guide system 34 described above and is not per se part of the present invention. The example adapter assembly 322 comprises a plate member 340, a skirt member 342, an adapter connector system 344, and one or more cushion members 346. The adapter assembly 322 comprises four cushion members 346*a-d* in the form of circular pieces of plywood. The adapter connector system 344 is adapted to support the skirt member 342 relative to the plate member 340.

With the drive system 320 in a driving configuration, the guide system aligns the base assembly 332 below the hammer system 330, the plate member 340 below the base assembly 332, and the skirt member 342 below the plate member 340 such that the skirt member 342 extends around at least the upper end 326 of the pile 324. The skirt member 342 further supports the cushion members 346*a-d* between the plate member 340 and the upper end 326 of the pile 324. The skirt member 342 is thus configured to align the pile 324 in a predetermined orientation with the plate member 340 and to maintain the at least one cushion member 346 between the plate member 340 and the pile 324.

When the drive system 320 is in the driving configuration, operation of the hammer system 330 applies a driving force on the base assembly 332. The base assembly 332 transmits at least a portion of the driving force to the plate member 340, and at least a portion of the driving force applied to the plate member 340 is in turn applied to the pile 324 through the cushion members 346*a-d*. Operation of the hammer system 330 thus applies a driving force to the pile 324.

The use of the adapter connector system 344 to support a skirt member 342 from a plate member 340 allows the driving force to be transmitted to the pile 324 without significant driving forces being applied to the skirt member 342. The skirt member 342 still effectively functions to align the plate member 340 with the pile 324 and to hold the cushion members 346*a-d* in position between the plate member 340 and the pile 324.

Given the foregoing general understanding of the construction and operation the first example drive system 320 of the present invention, the details of the construction and operation of the drive system 320 will now be described with reference to FIGS. 6-9.

The example hammer system 330 is a diesel hammer comprising a drive housing 350, a drive or anvil member 352, and an anvil cushion 354. When the hammer system 330 is operated, the drive member 352 is displaced downwardly in FIG. 6 relative to the drive housing 350. Alternatively, the hammer system 330 may take other forms such as a drop hammer or a hydraulic hammer. The construction and operation of hammer systems such as the example hammer system 330 is well-known in the art and will not be described herein beyond that extent necessary for a complete understanding of the present invention.

The example base assembly 332 comprises a base member 360, a strike plate 362, and a hammer cushion 364. The construction and operation of base assemblies such as the example base assembly 332 is well-known in the art and will not be described herein beyond that extent necessary for a complete understanding of the present invention.

The example base assembly 332 is adapted to transfer forces generated by the hammer system 330 to the adapter assembly 322. In particular, a base connecting system 366 suspends the base member 360 from the drive housing 350, and the base member 360 supports the strike plate 362 above the hammer cushion 364 and below the drive member 352. Accordingly, when the drive member 352 is displaced relative to the drive housing 350, the drive member 352 engages the strike plate 362 to apply a drive force to the strike plate 362. The drive force applied to the strike plate 362 is in turn transferred through the drive cushion 364 to the base member 360. The first example drive base assembly 332 is thus configured to transfer forces from the drive member 352 of the example hammer system 330 to the adapter assembly 322.

Like the guide system 34 described above, the guide system used in conjunction with the drive system 320 comprises first and second guide rails (not shown) held in a parallel relationship to define a drive axis A. The guide rails may be similar to the guide rails 70 and 72 described above and are configured to engage the hammer system 330, base assembly 332, and adapter assembly 322. Drive forces transmitted from the hammer system 330 to the pile 324 as described above are substantially directed along the drive axis A.

The adapter assembly 322 is further configured such that the pile 324 is supported such that a longitudinal axis of the pile is also substantially aligned with the drive axis A. The drive forces generated by the drive system 320 are thus transmitted to the pile 324 substantially along the drive axis A. The drive axis A is typically substantially vertical or canted at a desired angle with respect to vertical and directed at a desired location in the earth. The guide system may take the form of a lead assembly supported by a spotter or crane. The construction and operation of guide systems 334 such as the example guide system is well-known in the art and will not be described herein beyond that extent necessary for a complete understanding of the present invention.

The details of construction and assembly of the example adapter assembly 322 relative to the example base assembly 332 will now be described in further detail with respect to FIGS. 7-9.

Figure 8A:
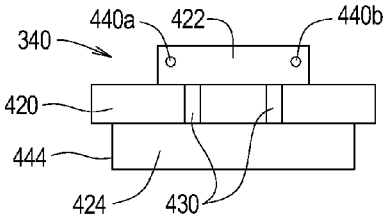
FIG. 8A is an elevation view of an example plate member of the second example adapter assembly of the present invention.
Figure 8B:
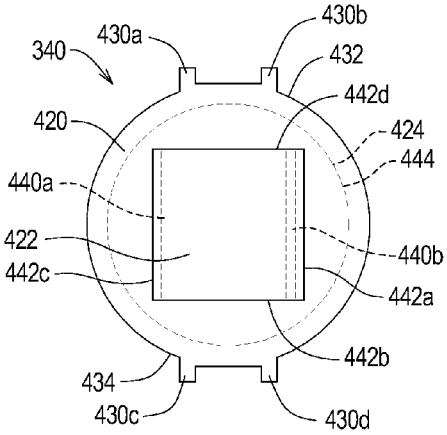
FIG. 8B is a top plan view of the example plate member depicted in FIG. 8A.

As shown in FIGS. 8A and 8B, the plate member 340 is a solid member comprising a center portion 420, an adapter base portion 422, and a skirt adapter portion 424. The example center portion 420 and skirt adapter portion 424 are circular solids, and the adapter base portion 422 is a rectangular solid. A cross-sectional area of the center portion 420 is larger than cross-sectional areas of the adapter base portion 422 and the skirt adapter portion 424. Thicknesses of the portions 420, 422, and 424 are defined by the environment in which the drive system 320 is to be used and the details of the base assembly 332 and the skirt member 342.

A plurality of rail guides 430 extend from opposing edge portions 432 and 434 of the plate center portion 420. The example plate member 340 comprises four rail guides 430*a-d* spaced from each other to engage the guide rails of the guide system. The opposing edge portions 432 and 434 are also spaced from each other a distance defined by the spacing between the guide rails.

At least one plate connector bore 440 is formed in the adapter base portion 422; the example plate member 340 comprises first and second plate bores 440*a* and 440*b*. The adapter base portion 422 further defines at least one first alignment surface 442, and the skirt adapter portion 424 defines at least one second alignment surface 444. As shown in FIG. 8B, the example adapter base portion 422 comprises four first alignment surfaces 442*a-d*, and the example skirt adapter portion 424 defines a circular second alignment surface 444 (FIGS. 8A and 8B). As will be described in further detail below, configuration of the alignment surfaces 442 is defined by the base member 360 and the configuration of the alignment surface 444 is defined by the skirt member 342.

Figure 7A:
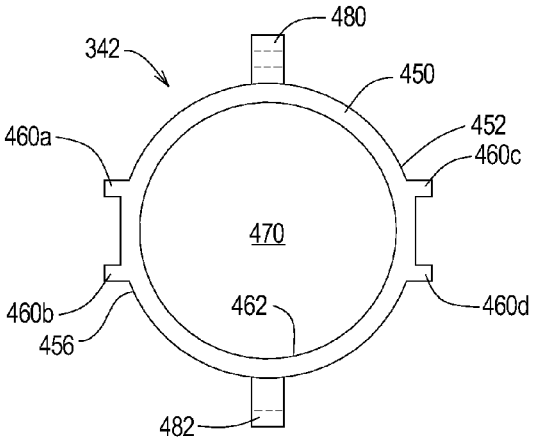
FIG. 7A is a top plan view of an example skirt member of a second example adapter assembly of the present invention.
Figure 7B:
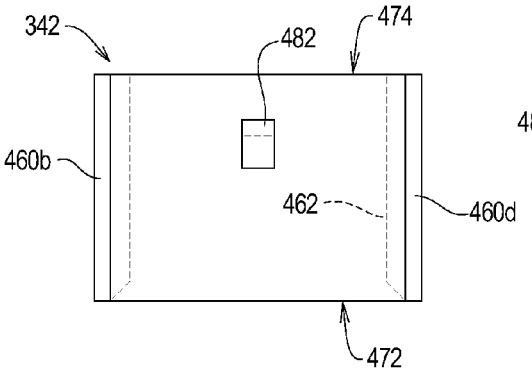
FIG. 7B is a first elevation view of the example skirt member depicted in FIG. 7A.
Figure 7C:
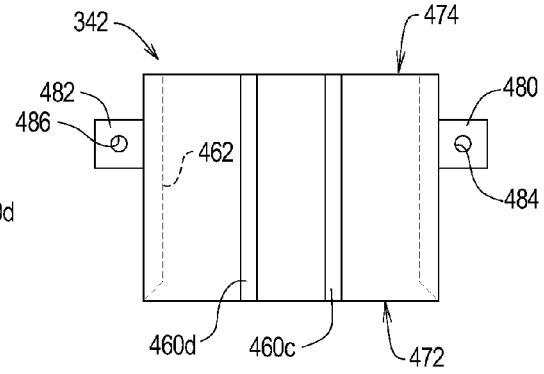
FIG. 7C is a second elevation view of the example skirt member depicted in FIG. 7A.

As shown in FIGS. 7A-7C, the skirt member 342 is a solid member comprising a wall 450. The wall 450 is substantially cylindrical. A plurality of rail guides 460 extend from opposing wall portions 452 and 456 of the skirt member 342. As shown in FIG. 7A, the example skirt member 342 comprises four rail guides 460*a-d* spaced from each other to engage the guide rails of the guide system. The opposing wall portions 452 and 456 are also spaced from each other (i.e., diameter of the cylindrical wall 450) a distance defined by the spacing between the guide rails. The wall 450 defines a wall surface 462.

The skirt member 342 defines a skirt chamber 470, a pile opening 472, and a plate opening 474. The skirt chamber 470 is sized and dimensioned to receive the upper end 326 of the pile 324. In particular, the example pile 324 is a concrete pile having a substantially circular cross-section; the skirt chamber 470 thus also defines a circular cross-section slightly larger than that of the pile 324. The pile 324 is inserted into the skirt chamber 470 through the pile opening 472 as shown in FIG. 6. The alignment surface 444 described above is sized and dimensioned to be received within the skirt chamber 470 as shown in FIG. 6, and at least a portion of the skirt adapter portion 424 is inserted into the plate opening 474.

FIGS. 7A-7C illustrate that first and second skirt connecting flanges 480 and 482 extend from the wall portions 452 and 458. These skirt connecting flanges 480 and 482 define first and second skirt connecting openings 484 and 486, respectively.

Figure 9A:
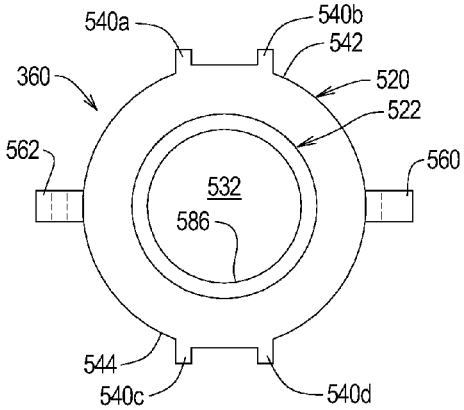
FIG. 9A is top plan view of an example base member that may be used with the second example adapter assembly.
Figure 9B:
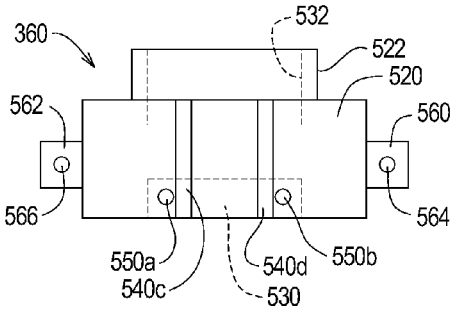
FIG. 9B is an elevation view of the example base member of FIG. 9A.
Figure 9C:
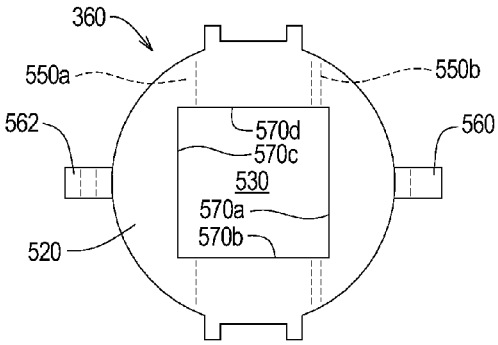
FIG. 9C is a bottom plan view of the example base member of FIG. 9A.

Turning now to FIGS. 9A-9C, the example base member 360 will be described in further detail. The example base member 360 is a solid member comprising a main portion 520 and a flange portion 522. An adapter cavity 530 is formed in the main portion 520, while a drive cavity 532 extends through the flange portion 522 and partly into the main portion 520.

A plurality of rail guides 540 extend from opposing surface portions 542 and 544 of the main portion 520. As shown in FIG. 9A, the example base member 360 comprises four rail guides 540*a-d* spaced from each other to engage the guide rails of the guide system. The opposing surface portions 542 and 544 are also spaced from each other a distance defined by the spacing between the guide rails.

At least one plate connector bore 550 is formed in the main portion 520; in particular, the example base member 360 comprises first and second base bores 550*a* and 550*b*. First and second drive connecting flanges 560 and 562 extend from the main portion 520. These drive connecting flanges 560 and 562 define first and second drive connecting openings 564 and 566, respectively.

The main portion 520 of the base member 360 defines at least one alignment surface 570 defining the adapter cavity 530. The example main portion 520 defines four alignment surfaces 570*a-d* in a rectangular configuration that is slightly greater in cross-sectional area than the cross-sectional area of the adapter base portion 422 of the plate member 340. The example adapter cavity 530 of the base member 360 is thus sized and dimensioned to receive the adapter portion 422 of the plate member 340. With the adapter portion 422 properly received by the adapter cavity 530, the base bores 550*a* and 550*b* are aligned with the plate bores 440*a* and 440*b* as shown in FIG. 6.

As perhaps best shown in FIG. 6, the adapter connector system 344 may be formed by one or more cables 580 inserted through the aligned plate bores 440 and base bores 550 and through the skirt connecting openings 484 and 486 to secure the plate member 340 to the base member 360 and to the skirt member 342. As shown in FIG. 6, the cables 580 should have some slack to allow a gap 582 between an upper edge 584 of the skirt member 342 and the main portion 420 of the plate member 340 when the drive system 320 is in use. Other connecting systems may be used to connect the various members 360, 340, and/or 342 together. For example, while a single cable 580 is used to connect the plate member 340 to the base member 360 and to the skirt member 342 in the example drive system 320, a first connector may be used to connect to the plate member 340 to the base member 360 and a second connector may be used to plate member 342 to the skirt member 342.

The flange portion 522 and main portion 520 of the base member 360 further defines an alignment surface 586 defining the drive cavity 532. In particular, the example alignment surface 586 is arranged in a circular configuration that is slightly greater in cross-sectional area than the cross-sectional area of the strike plate 362 and the drive cushion 364. The example drive cavity 532 of the base member 360 is thus sized and dimensioned to support the strike plate 362 and drive cushion 364 as shown in FIG. 6 such that displacement of the drive member 352 is transmitted to the base member 360 through the strike plate 362 and the drive cushion 364.

Additionally, FIG. 6 illustrates that first and second housing connecting flanges 590 and 592 extend from the drive housing 350. These housing connecting flanges 590 and 592 define first and second housing connecting openings 594 and 596, respectively. The base connector system 366 may be formed by one or more cables 598 inserted through the drive connecting openings 564 and 566 and the housing connecting openings 594 and 596. The example drive system 320 employs first and second cables 598*a* and 598*b*.

C. Third Example Drive System

Figure 10:
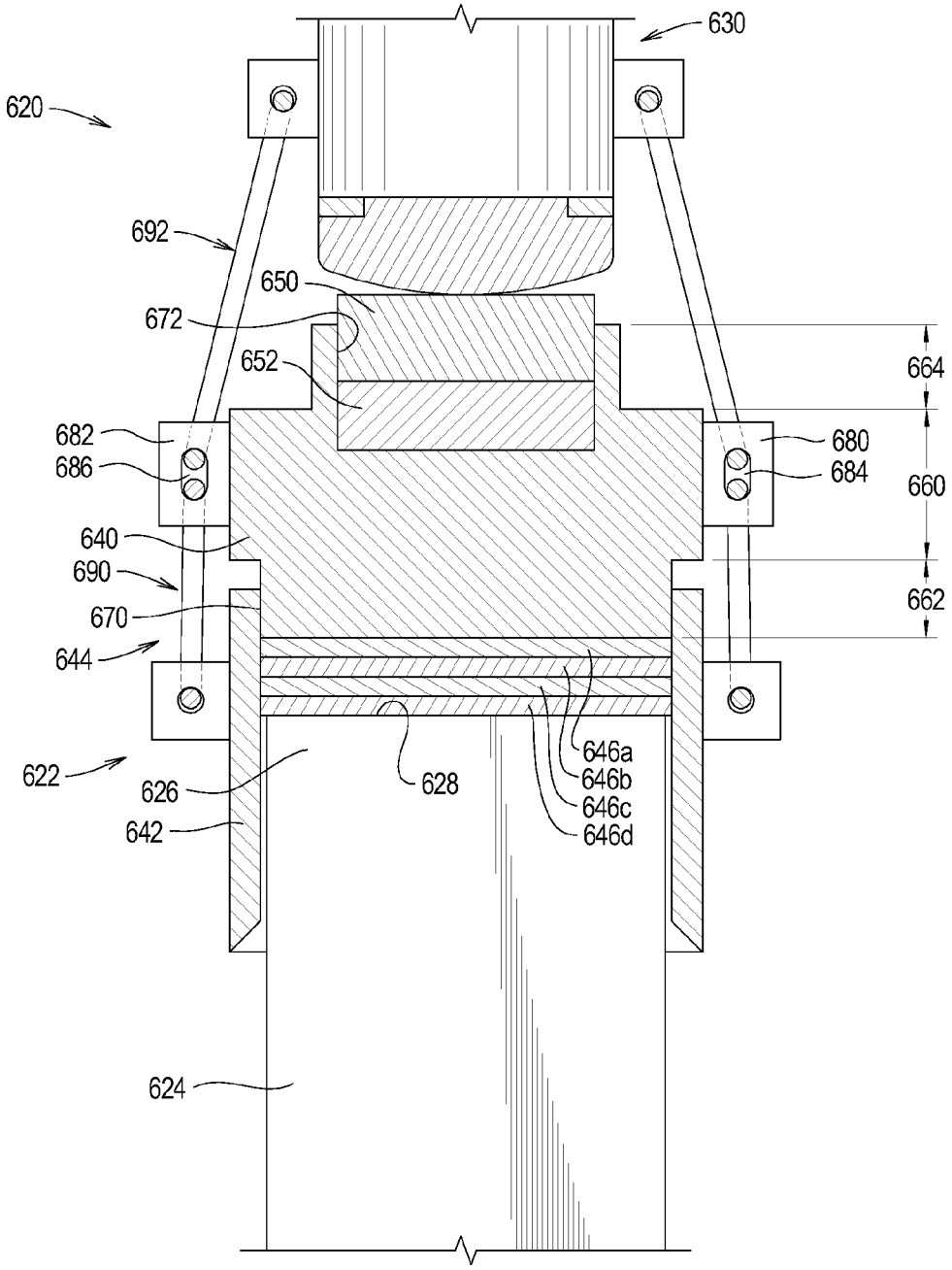
FIG. 10 is an elevation, sectional view of a third example drive system for concrete piles employing a third example adapter assembly of the present invention.

Referring now to FIG. 10 of the drawing, depicted therein is a third example drive system 620 comprising a third example adapter assembly 622 embodying, and constructed in accordance with, the principles of the present invention. The example third drive system 620 is configured to drive a pile 624 defining a pile upper end 626 and a pile upper surface 628. The example pile 624 is a concrete pile having a generally circular cross-section, but, as will be described in further detail below, the principles of the present invention may be applied to piles of other materials such as steel or wood and having other cross-sections such as circular.

In addition to the adapter assembly 622, the third example drive system 620 comprises a hammer system 630 and a guide system (not shown). The guide system may be like the guide system 34 described above and is not per se part of the present invention.

The example adapter assembly 622 comprises a plate member 640, a skirt member 642, an adapter connector system 644, one or more cushion members 646, a drive plate 650, and a drive cushion 652. The example adapter assembly 622 comprises four cushion members 646*a-d* in the form of rectangular pieces of plywood. The adapter connector system 644 is adapted to support the skirt member 642 relative to the plate member 640.

With the drive system 620 in a driving configuration, the guide system aligns the plate member 640 below the hammer system 630 and the skirt member 642 below the plate member 640 such that the skirt member 642 extends around at least the upper end 626 of the pile 624. The skirt member 642 further supports the cushion members 646*a-d* between the plate member 640 and the upper end 626 of the pile 624. The skirt member 642 is thus configured to align the pile 624 in a predetermined orientation with the plate member 640 and to maintain the at least one cushion member 646 between the plate member 640 and the pile 624.

When the drive system 620 is in the driving configuration, operation of the hammer system 630 applies a driving force on the plate member 640 through the drive plate 650 and the drive cushion 652, and at least a portion of the driving force applied to the plate member 640 is in turn applied to the pile 624 through the cushion members 646*a-d*. Operation of the hammer system 630 thus applies a driving force to the pile 624.

The use of the adapter connector system 644 to support a skirt member 642 from a plate member 640 allows the driving force to be transmitted to the pile 624 without significant driving forces being applied to the skirt member 642. The skirt member 642 still effectively functions to align the plate member 640 with the pile 624 and to hold the cushion members 646*a-d* in position between the plate member 640 and the pile 624.

The example drive system 620 is similar in many respects to the drive system 20 described above. In particular, the plate member 640 performs the functions of both the plate member 40 and the base member 60 described above and thus eliminates the need for a separate base member. The example drive system 620 will be described herein only to that extent that it differs from the example drive system 20 described above.

The example plate member 640 comprises is a solid member comprising a main portion 660, a base portion 662, and a flange portion 664. The adapter base portion 662 defines at least one alignment surface 670. The configuration of the alignment surface(s) 670 is defined by the skirt member 642. A drive cavity 672 extends through the flange portion 664 and partly into the main portion 660. The drive cavity 672 is adapted to support the drive cushion 652 and the drive plate 650.

In the example drive system 620, the impact of the hammer system 630 is delivered through the drive plate 650 and the drive cushion 652 and then directly to the plate member 640. The need for a base member to support the drive plate 650 and drive cushion 652 is omitted.

In the third example drive system 620, first and second pairs of connecting flanges 680 and 682 are formed on the plate member 640 defining first and second connecting holes 684 and 686. A first connecting system 690 extends between the connecting holes 684 and 686 and the skirt member 642, while a second connecting system 692 extends between the connecting holes 684 and 686 and the hammer system 630. The connecting systems 690 and 692 thus allow the hammer system 630, plate member 640, and skirt member 642 to be lifted together.

From the foregoing, it should be apparent that the present invention may be embodied in many different combinations and sub-combinations of the elements and steps described above. The scope of the present invention should thus be determined by the claims to be appended hereto and not the foregoing detailed description.

What is claimed is:

1. A combination of:

a pile defining a pile axis;

a hammer for applying a drive force to a drive member along a drive axis;

a base portion operatively supported relative to the drive member such that the drive force is transmitted to the base portion; and an adapter assembly comprising a plate member defining a center portion and a skirt adapter portion defining at least one alignment surface, a skirt member defining a skirt chamber, a pile opening, and a plate opening, where the skirt adapter portion of the plate member extends through the plate opening and at least partly into the skirt chamber and such that the at least one alignment surface engages the skirt member such that the skirt member may move relative to the plate member along the drive axis, and the skirt member is substantially aligned with the drive axis, wherein the skirt chamber is sized and dimensioned to receive an upper portion of the pile, and an adapter connector that suspends the skirt member from the plate member such that a gap is maintained between the skirt member and the center portion of the plate member during operation of the pile driving system; whereby an upper portion of the pile is inserted through the pile opening and into the skirt chamber such that the skirt member engages the upper portion of the pile to align the drive axis with the pile axis;

the drive force is transmitted along the drive axis from the base portion to the upper portion of the pile through the plate member; and the gap between the skirt member and the center portion of the plate member allows movement of the skirt member relative to the plate member along the drive axis such that the skirt member is substantially isolated from the drive force.

2. A combination as recited in claim 1, further comprising at least one guide rail that engages the hammer and the adapter assembly such that the drive force is substantially directed along the drive axis.

3. A combination as recited in claim 1, in which the base portion comprises a base member defining an adapter cavity and the plate member further comprises an adapter base portion, where the adapter cavity receives the adapter base portion such that the drive force is substantially directed along the drive axis.

4. A combination as recited in claim 1, in which:

the base portion comprises a base member defining a drive cavity;

the drive cavity supports a strike plate and a hammer cushion; and the drive member transmits the drive force to the plate member through the strike plate, the hammer cushion, and the base member.

5. A combination as recited in claim 1, in which:

the base portion defines a drive cavity;

the drive cavity supports a strike plate; and the drive member transmits the drive force to the plate member through the strike plate.

6. A combination as recited in claim 1, in which the base portion comprises a base member defining an adapter cavity and a drive cavity, wherein:

the adapter cavity receives the adapter base portion such that the drive force is transmitted through the base member and the adapter plate substantially along the drive axis; and the drive cavity supports a strike plate and a hammer cushion, where the drive member transmits the drive force to the plate member through the drive plate and the base member.

7. A combination as recited in claim 1, in which the hammer comprises a drive housing that supports the drive member for movement relative to the drive housing along the drive axis, the pile driving system further comprising at least one base connector for connecting the base portion to the drive housing.

8. A combination as recited in claim 1, further comprising at least one cushion member arranged within the skirt cavity below the plate member during operation of the pile driving system.

9. A method of driving a pile defining a pile axis, comprising the steps of:

providing a plate member defining a center portion and a skirt adapter portion defining at least one alignment surface;

providing a skirt member defining a skirt chamber, a pile opening, and a plate opening, where the skirt chamber is sized and dimensioned to receive an upper portion of the pile;

arranging the skirt adapter portion of the plate member through the plate opening and into the skirt chamber, where the at least one alignment surface of the skirt adapter portion engages the skirt member such that the skirt member may move relative to the plate member along the drive axis, and is substantially aligned with the drive axis, and suspending the skirt member from the plate member such that a gap is maintained between the skirt member and the center portion of the plate member during operation of the pile driving system;

inserting an upper portion of the pile through the pile opening and into the skirt chamber such that an inner surface of the skirt member engages the upper portion of the pile to align a drive axis with the pile axis; and applying a drive force to the drive member along the drive axis such that the drive force is transmitted from the drive member to the pile through the plate member; and the gap allows movement of the skirt member relative to the plate member to substantially isolate the skirt member from the drive force transmitted from the plate member to the pile.

10. A method as recited in claim 9, further comprising the step of arranging at least one guide rail relative to the drive member and the plate member such that the drive forces are substantially directed along the drive axis.

11. A method as recited in claim 9, further comprising the step of arranging a strike plate and a hammer cushion such that the drive force is transmitted from the drive member to the plate member through the strike plate and the hammer cushion.

12. A method as recited in claim 9, further comprising the step of:

providing a base member defining an adapter cavity and a drive cavity;

arranging the adapter base portion within the adapter cavity such that the drive force is transmitted through the base member and the adapter plate substantially along the drive axis; and supporting a strike plate and a hammer cushion within the drive cavity such that the drive force is transmitted to the plate member through the drive plate and the base member.

13. A method as recited in claim 9, further comprising the step of arranging at least one cushion member within the skirt cavity between the pile and the plate member.

14. A combination of:

a pile defining a pile axis;

a pile driving system defining a drive axis;

an adapter system for transmitting a drive force from the pile driving system to the pile comprising a base assembly operatively supported such that the drive force is transmitted to the base assembly; and an adapter assembly comprising a plate member defining a center portion and a skirt adapter portion defining at least one alignment surface, a skirt member defining a skirt chamber, a pile opening, and a plate opening, where the skirt chamber is sized and dimensioned to receive an upper portion of the pile, and the skirt adapter portion of the plate member extends through the plate opening and at least partly into the skirt chamber and such that the at least one alignment surface engages the skirt member such that the skirt member may move relative to the plate member along the drive axis and is substantially aligned with the drive axis, and an adapter connector that supports the skirt member from the plate member such that a gap is maintained between the skirt member and the center portion of the plate member during operation of the pile driving system; whereby the adapter assembly is arranged substantially to align the drive axis with the pile axis;

an upper portion of the pile is inserted through the pile opening and into the skirt chamber such that the drive force is transmitted from the plate member to the pile, and an inner surface of the skirt member engages the upper portion of the pile to align the drive axis with the pile axis;

the drive force is transmitted along the drive axis from the base portion to the upper portion of the pile through the plate member; and the gap between the skirt member and the center portion of the plate member allows movement of the skirt member relative to the plate member along the drive axis such that the skirt member is substantially isolated from the drive force.

15. A combination as recited in claim 14, in which the base assembly comprises a base member defining an adapter cavity and a drive cavity, wherein:

the adapter cavity receives the adapter base portion such that the drive force is transmitted through the base member and the adapter plate substantially along the drive axis; and the drive cavity supports a strike plate and a hammer cushion, where the drive member transmits the drive force to the plate member through the drive plate and the base member.

16. A combination as recited in claim 14, in which the adapter connector supports the skirt member relative to the plate member such that a gap exists between an upper edge of the skirt member and a center portion of the plate member.

17. A combination as recited in claim 14, in which the base portion is integrally formed with the plate member.

* * * * *